US009085838B2

(12) United States Patent
Maldonado Arellano

(10) Patent No.: US 9,085,838 B2
(45) Date of Patent: Jul. 21, 2015

(54) FLOOR MAT ARTICLE

(75) Inventor: Raul Maldonado Arellano, San Luis Potosi (MX)

(73) Assignee: 3M Innovative Properties Company, St. Paul, MN (US)

( * ) Notice: Subject to any disclaimer, the term of this patent is extended or adjusted under 35 U.S.C. 154(b) by 492 days.

(21) Appl. No.: 13/230,219

(22) Filed: Sep. 12, 2011

(65) Prior Publication Data

US 2012/0064324 A1 Mar. 15, 2012

Related U.S. Application Data

(60) Provisional application No. 61/382,568, filed on Sep. 14, 2010.

(51) Int. Cl.

| | |
|---|---|
| ***D04H 1/70*** | (2012.01) |
| ***D04H 1/58*** | (2012.01) |
| ***D06N 7/00*** | (2006.01) |
| ***A47L 23/26*** | (2006.01) |

(52) U.S. Cl.

CPC ..... *D04H 1/70* (2013.01); *A47L 23/266* (2013.01); *D04H 1/58* (2013.01); *D06N 7/006* (2013.01); *D06N 7/0068* (2013.01); *D06N 2209/1664* (2013.01); *D06N 2213/066* (2013.01)

(58) Field of Classification Search

CPC ..... A47L 23/266; D04H 2213/066; D04H 7/006; D04H 7/0068; B32B 27/04; B32B 27/12; B32B 5/02; B05D 3/00; B05D 3/02; B05D 5/10

USPC ..... 428/95–98, 77, 102–114, 220; 442/60, 442/149, 151, 152, 153, 154, 155, 164, 165, 442/166, 167, 168, 169, 170, 171, 172–180, 442/327, 334, 394; 427/208.8

See application file for complete search history.

(56) References Cited

U.S. PATENT DOCUMENTS

| | | | | |
|---|---|---|---|---|
| 2,958,593 | A | 11/1960 | Hoover | |
| 3,012,911 | A | 12/1961 | Moser | |
| 3,378,398 | A | 4/1968 | Nottebohm | |
| 3,449,486 | A | 6/1969 | Contractor | |
| 3,537,121 | A | 11/1970 | McAvoy | |
| 4,731,066 | A * | 3/1988 | Korpman | 604/366 |
| 4,893,439 | A | 1/1990 | McAvoy | |

(Continued)

FOREIGN PATENT DOCUMENTS

| | | |
|---|---|---|
| DE | 102 35 175 | 2/2004 |
| EP | 1 462 559 | 9/2004 |
| EP | 1 662 044 | 5/2005 |
| EP | 1 541 763 | 6/2005 |

(Continued)

*Primary Examiner* — Arti Singh-Pandey

(74) *Attorney, Agent, or Firm* — David B Patchett

(57) ABSTRACT

A floor mat article for removing and holding dust, mud, dirt, and water and a process for making a floor mat. The matting article can include a lofty nonwoven web of entangled fibers and a pressure-sensitive adhesive coating. The lofty nonwoven web can include organic crimped staple fibers which can be adhesively bonded together by a binder resin to form a three dimensional network of intercommunicated voids constituting at least 75% of the volume. The matting article can have a maximum density of 95 kilograms per cubic meter. The process can include forming a nonwoven web of crimped staple organic fibers; coating the nonwoven web with a binder resin; heat curing the coated nonwoven web; and applying a pressure-sensitive adhesive to a first major surface of the coated nonwoven web.

20 Claims, 2 Drawing Sheets

(56) References Cited

U.S. PATENT DOCUMENTS

| | | | | |
|---|---|---|---|---|
| 5,562,646 | A * | 10/1996 | Goldman et al. | 604/368 |
| 6,127,027 | A * | 10/2000 | Nogami et al. | 428/220 |
| 2003/0008586 | A1 | 1/2003 | Kajander | |
| 2005/0130527 | A1 * | 6/2005 | Sebastian et al. | 442/149 |
| 2005/0181693 | A1 | 8/2005 | Kajander | |
| 2007/0123132 | A1 | 5/2007 | Erb | |

FOREIGN PATENT DOCUMENTS

| | | |
|---|---|---|
| EP | 1 584 724 | 10/2005 |
| EP | 1 710 337 | 10/2006 |
| EP | 1 746 209 | 1/2007 |
| JP | 02-277867 | 11/1990 |
| JP | 04-082947 | 3/1992 |
| WO | WO 2006/100065 | 9/2006 |

* cited by examiner

FLOOR MAT ARTICLE

CROSS REFERENCE TO RELATED APPLICATIONS

This application claims priority from U.S. Provisional Application Ser. No. 61/382,568 filed Sep. 14, 2010, the disclosure of which is incorporated by reference in its/their entirety herein.

FIELD OF THE INVENTION

The present disclosure relates to a floor care article and the method of making same, and more particularly relates to a matting article having a lightweight, lofty nonwoven web of organic fibers adhesively bonded together by a binder resin and including a pressure-sensitive adhesive coating.

BACKGROUND

Durable floor mats created for demanding institutional applications, such as main entrance in buildings or manufacturing locations, may have constructions that require complex equipment and multiple processing steps that impact manufacturing investment and, therefore, cost to customer.

Some durable floor mats are constructed as a nonwoven material mounted on a polyvinylchloride sheet, and these may retain dirt, dust and water, but the structure is such that the used mat may become heavy. The cost of a new mat may drive the customer to attempt to clean the used, heavy mat, which can result in additional cost or worker time to take care of their matting, and if the cleaning is not done properly, the mat may not be as effective as a fresh, new mat.

U.S. Pat. No. 3,012,911 (Moser) purportedly describes bonded nonwoven fibrous products and methods of producing them.

U.S. Pat. No. 3,378,398 (Ludwig et al.) purportedly describes highly-porous regenerable thermoplastic fiber mats suitable for filtration of gases, scouring operations and abrasive operations.

U.S. Pat. No. 3,449,486 (Kern et al.) purportedly describes a method for producing a thermally self-bonded low density nonwoven product.

SUMMARY

In one aspect, a matting article is disclosed for removing and holding dust, mud, dirt, and water, the matting article comprising a lofty nonwoven web of entangled fibers comprising crimped staple organic fibers which are adhesively bonded together by a binder resin to form a three dimensional network of intercommunicated voids constituting at least about 75% of the volume of the nonwoven web; and a coating of pressure-sensitive adhesive on a first major surface of the matting article; wherein the matting article has a maximum density of 95 kilograms per cubic meter.

In another aspect, a process is disclosed for making the matting article of claim 1, the process comprising forming a nonwoven web of crimped staple organic fibers; coating the nonwoven web with a binder resin; heat curing the coated nonwoven web; and applying a pressure-sensitive adhesive to a first major surface of the coated nonwoven web. The lightweight matting article so produced is easy to handle and place on main entrance doors of office buildings, stores, restaurants, schools, warehouses or workshops, and may remain durable through multiple cycles of washing and drying.

Other features and aspects of the present disclosure will become apparent by consideration of the detailed description and accompanying drawings.

DETAILED DESCRIPTION

Before any embodiments of the present disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. It is to be understood that other embodiments may be utilized and structural or logical changes may be made without departing from the scope of the present disclosure.

The present disclosure generally relates to a matting article that can remove and hold dust, mud, dirt and water.

Figure 1:
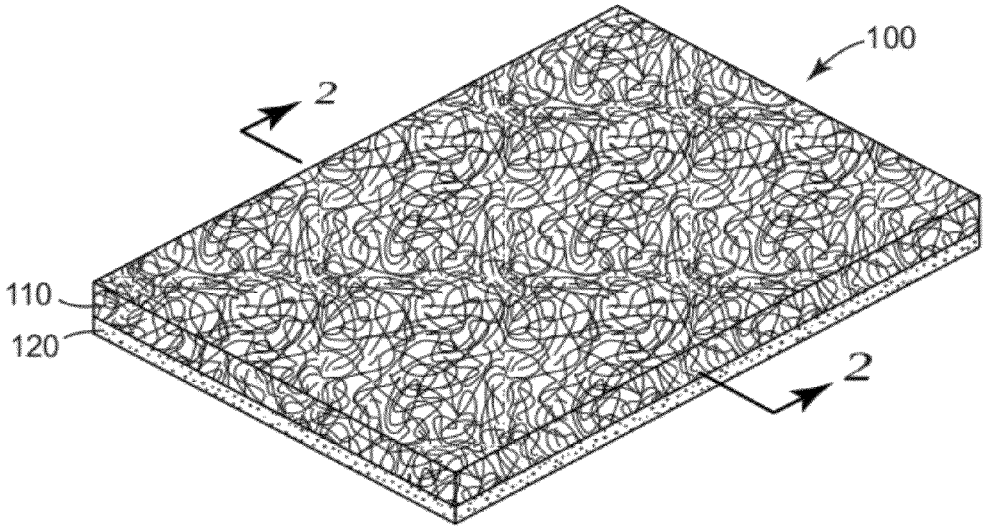
FIG. 1 is a perspective view of a matting article according to one embodiment of the present disclosure.
Figure 2:
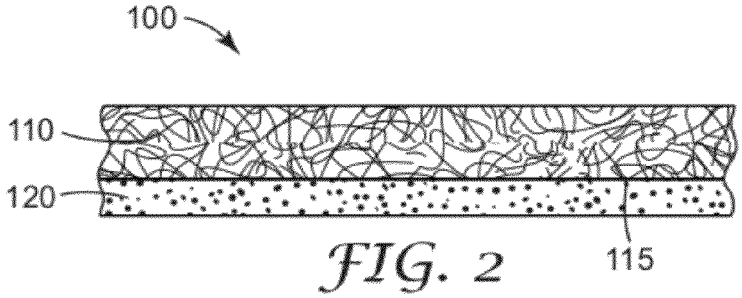
FIG. 2 is a cross-sectional view of the matting article of FIG. 1.
Figure 3:
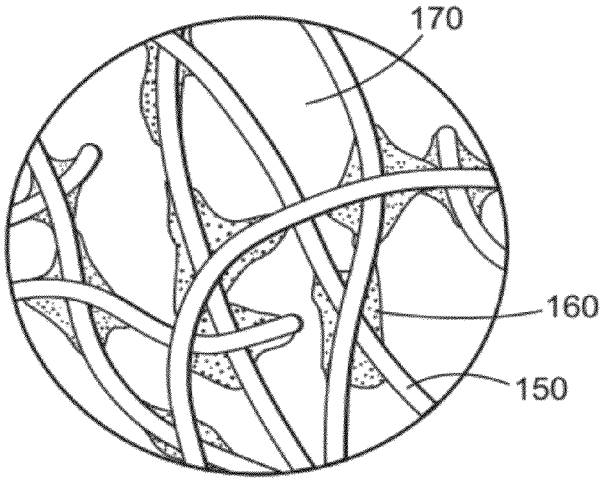
FIG. 3 is a detail view of the lofty nonwoven web of the matting article of FIG. 1, showing fibers which are adhesively bonded together.

FIG. 1 is a perspective view of one embodiment of a matting article 100, including a lofty nonwoven web 110 and a pressure-sensitive adhesive layer 120. FIG. 2 is a cross-sectional view of the matting article 100 after the formation of pressure-sensitive adhesive layer 120 on a major surface 115 of lofty nonwoven web 110. FIG. 3 is a detail view of a portion of lofty nonwoven web 110, showing fibers 150 adhesively bonded together by a binder resin 160 to form a three dimensional network of intercommunicated voids 170. The fibers 150 are randomly arranged, forming a uniform, lofty nonwoven mat of fibers.

The weight of fiber per square meter of the lofty nonwoven web may be varied to obtain different densities in the range of 10 kilograms per cubic meter to 95 kilograms per cubic meter. This density range represents an open and light article that distributes dust, mud and water in its spaces. In some embodiments, the matting article may have a density in the range of greater than 20 kilograms per cubic meter to 95 kilograms per cubic meter. In some embodiments, the matting article may have a maximum density of 20 kilograms per cubic meter. The thickness of the lofty nonwoven web also may be varied, and in some embodiments, the thickness of a matting article 100 can be in the range of from 0.5 centimeters to 2.0 centimeters. In some embodiments, the thickness of a matting article 100 can be in a range of from 1.0 to 1.5 centimeters.

The low density of lofty nonwoven web is due in part to the characteristics of the staples fibers, including size, length and crimp, which are selected to form interstices between adjacent fibers that are open and substantially unfilled by the binder resin. Such interstices form a network of intercommunicated voids constituting at least about 75 percent of the volume of the matting article 100. The size of the fibers is designated by the unit "denier." "Denier" is here defined as the weight in grams of a fiber 9000 meters in length. Typically, a 15 denier staple fiber is lighter and has a smaller diameter than a 200 denier fiber. Fibers for some embodiments of the article of the present disclosure may have a size in a range of 3 denier to 200 denier, and in some embodiments the fiber size may be in a range of 15 denier to 80 denier.

Typically, matting article 100 is flexible and readily compressible, and upon release of pressure, capable of recovering substantially completely to its initial uncompressed form. This property may be important to consider in markets where products such as floor wipes, carton sheets and textiles are commonly used to reduce dust, mud and water introduced to office buildings, stores, restaurants, schools, warehouses and workshops.

Figure 4:
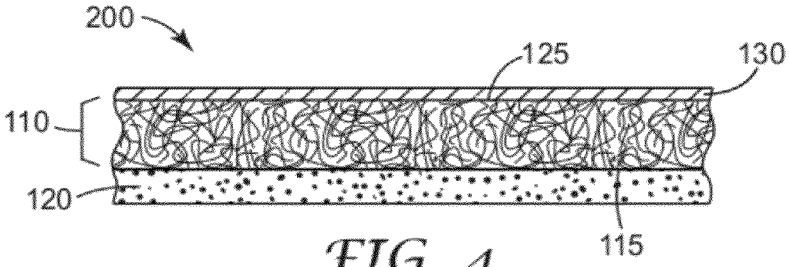
FIG. 4 is a cross-sectional view of a matting article having an additional layer of binder resin according to another embodiment of the present disclosure.
Figure 5:
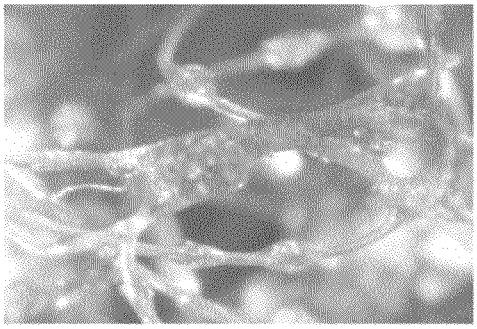
FIGS. 5 and 6 are microscopic views of an embodiment of a matting article of the present disclosure.

FIG. 4 illustrates another embodiment of a matting article 200 of the present disclosure, similar to matting article 100 embodiment shown in FIGS. 1 and 2, but having an additional layer of binder resin 130 that has been applied to a second major surface 125 of a heat cured matting article 100. It will be understood that a portion of additional layer of binder resin 130 may penetrate into at least a portion of lofty nonwoven web 110, and that the binder resin material in additional layer of binder resin 130 may be the same as or different from binder resin 160 present in lofty nonwoven web 110.

Fibers

A matting article 100 of the present disclosure includes organic staple fibers having a particular crimp profile and length that permit forming a nonwoven web that is coated with a binder resin to make it stable to traffic of people and vehicles. The organic staple fibers may be stuffer-box crimped, gear crimped, helically crimped (as described for example in U.S. Pat. No. 4,893,439 (McAvoy et al.), the description of which is incorporated herein by reference), or a combination of these or other fibers crimped by equivalent means known to those having skill in the art.

Crimp is a characteristic that helps to supports the construction of a nonwoven structure by creating the contact of individual fibers with one another, as well as the open spaces where the dust, mud and water will be retained. Crimp also helps to create a soft scouring effect on the surfaces that move across the matting article such as people's shoes or vehicle's wheels, so the dust and mud is removed and then trapped in the matting article. Crimp in the fibers in some embodiments for the present disclosure can be selected from the range of 2 to 8 crimps per centimeter.

Length of the fiber is selected during the manufacture of the staple fibers, depending on the type of process where a nonwoven product will be made and the final application where the nonwoven product will be directed. For a matting article 100 of the present disclosure the length of the fibers may be in a range of 3 centimeters to 10 centimeters, or in a range of 4 centimeters to 8 centimeters.

Composition of the fibers can include a polymer selected from the group consisting of polypropylene, polyethylene, polyamide, polyethylene terephthalate, polyester and combinations thereof.

Examples of staple fibers having the characteristics described above include, for example, 200 denier polyamide 6,6 fiber manufactured and distributed by Rhodia S.A. (Paris, France), 15 denier DACRON polyester fiber distributed by DAK Fibers (Mexico City, Mexico), 17 denier polyamide 6,6, fiber manufactured and distributed by Nexis Fibers (Emmenbrucke, Switzerland), 4 denier polypropylene T-196 fiber manufactured and distributed by Fibervisions (Covington, USA) and 70 denier polyamide 6,6 fiber manufactured and distributed by Meryl Fiber S.A.S (Saint-Laurent-Blangy, France).

Other fiber compositions may be suitable to make a matting article 100 of the present disclosure, if the characteristics described above are present.

Binder Resin

A binder resin 140 of the current description may include a resin capable of being cured with heat, including those binder resins selected from the group consisting of acrylic resin, phenolic resin, nitrile resin, ethylene vinyl acetate resin, polyurethane resin, styrene-butadiene resin, styrene-acrylic resins, vinyl acrylic resin and combinations thereof. Binder resin 140 is typically applied as a mixture including water and, optionally, a crosslinker agent that ensures crosslinking of the polymer in the resin. Examples of suitable binder resin includes, for example, Rovene 5900 manufactured and distributed by Mallard Creek Polymers (North Carolina, USA), Rhoplex TR-407 manufactured and distributed by Dow Company (New Jersey, USA), and Aprapole SAF17 manufactured and distributed by AP Resinas (Mexico City, Mexico.) Other binder resins that may be heat curable are an extension of the present disclosure if the compatibility with the fibers is found.

In some embodiments, the amount of heat cured binder resin as dried solids may be in a range of from 20 grams per square meter to 400 grams per square meter, and in some embodiments, the amount of heat cured binder resin as dried solids may be 98 to 110 grams per square meter.

The optional crosslinker agent can include, for example, melamine formaldehyde dispersions, like Cymel 303 manufactured and distributed by Cytec Industries (New Jersey, USA), and Resimene 747 manufactured and distributed by Ineos Melamines (Massachusetts, USA.). Crosslinker in some embodiments can be added in a range of 2.5 to 8% in weight of the total mixture of binder resin prepared.

In some embodiments, additional ingredients such as talc, silica, calcium carbonate and other fillers as well as pigment dispersions can be added to the binder resin mixture to complete the matting article design. Non-limiting examples of optional fillers can include Omyacarb 10-SJ calcium carbonate manufactured and distributed by Omya (Safenwil, Switzerland), and talc Yellowstone grade distributed by Luzenac Sierra (Mexico city, Mexico). Filler can be added in a range of 10-25% in weight of the total mixture of the binder resin prepared.

In some embodiments, a second binder resin solution may be added with a spray system onto to a major surface of lofty nonwoven web 110 in a range of from 36 grams per square meter to 240 grams per square meter as dried total solids. The second binder resin composition may include the same components as the first binder resin solution. In some embodiments, the second binder resin solution may have a composition different from the first binder resin solution, including components selected from among those described above.

Pressure-Sensitive Adhesive

A pressure-sensitive adhesive is coated on a major surface of lofty nonwoven web 110 to maintain matting article 100 in position on, for example, a floor surface, and permit an easy removal after the using time. The pressure-sensitive adhesive is applied as small particles to avoid excess of tackiness and adhesive failure with time on the surface where the matting article is placed. In some embodiments, an average amount of dried pressure-sensitive adhesive may be in a range of from 8 grams per square meter to 60 grams per square meter, and in some embodiments an average amount of dried pressure-sensitive adhesive may be about 18 grams per square meter.

The pressure-sensitive adhesive (PSA) can be selected from the group of a water-based PSA or a solvent-based PSA and may include a PSA selected from the group consisting of acrylic adhesive, ethylene-vinyl acetate adhesive, synthetic rubber adhesive, natural rubber adhesive, tackifier resin adhesive, and combinations thereof. Suitable examples of pressure-sensitive adhesives are commercially available from AP Resinas (Mexico City, Mexico) like Flexbond 165 water based ethylene-vinyl copolymer adhesive and Stahl de Mexico (Toluca, Mexico) like AC278 water based acrylic adhesive.

A matting article 100 of the present disclosure avoids the introduction of a plastic or paper layer to work as a backing for the nonwoven fibers and the pressure-sensitive adhesive, reducing the cost due to raw materials and additional manufacturing steps. The creation of the nonwoven structure, the coating with a binder adhesive, and the pressure-sensitive adhesive can be processed in regular nonwoven and coating machinery making specific adjustments that permit to produce the matting article, at low cost and with low initial capital investment.

Methods

Methods useful for making lofty nonwoven webs suitable for conversion to floor matting articles of the present disclosure may include those described in U.S. Pat. No. 2,958,593 (Hoover et al.) and U.S. Pat. No. 3,537,121 (McAvoy), the descriptions of each of which are incorporated herein by reference.

Fibers can be processed and entangled into nonwoven webs by conventional web-forming machines such as the sold under the commercial name of "Rando Webber" (commercially available from Rando Machine Corporation, Macedon, N.Y., US.) Alternatively, the web forming machines could be one that produces a dry-laid web by carding and cross-lapping, rather than by air-lying; the cross-lapping may be horizontal (for example, using a "Profile Series" cross-lapper commercially available from ASSELIN-THIBEAU (Elbeuf sur Seine, 76504 France) or vertical (for example, using the "Wave-maker" system from Santex AG, Switzerland.)

The web formation begins at the feeding of the fibers into a conventional Garnett machine to loosen and to separate the fibers from the strands in which many exist as received from the manufacturer, this preliminary step being recommended to be done but not considered essential. The loose staple fiber from the Garnett machine is then transferred to a feed box of the Rando Webber machine, the feed box being kept approximately one-fourth to three-fourths filled in order to create a uniform web. The machine is started later on and adjusted to form a random web having a weight within the tolerance limits of 98-724 grams per square meter, the width of the web may vary in the tolerance range of 0.9-1.4 meters and its thickness in the range of 4 centimeters to 8 centimeters. When the Rando Webber machine is producing a uniform open web within the desired tolerances, the web from the machine is led onto a continuous conveyor belt system that brings the web to the step where the binder solution is applied. The binder solution may be applied when the open web passes between a pair of vertically opposed, rotating, 250 mm diameter rubber covered, squeeze rollers, separated by a gap in the range of 1.5 to 2.5 millimeters. The amount of binder solution may have a weight within the tolerance limits of 20-400 grams per square meter as dried total solids. This procedure is called "roll coating" and the zone created is called roll coated zone 110. The rotating lower roll, which is immersed in the binder solution, carries sufficient binder solution to the web so as to coat it completely.

An alternative "roll coating" procedure involves submerging the open web in the binder solution deposited in a deep pan and then pass the wet web between the squeeze rollers. The wet web is dried and the binder solution cured in a hot air oven at about 90-180° C. for about 30 to 240 seconds.

In some embodiments, after performing either of the "roll coating" procedures to produce a cured binder, an additional coating with binder solution on a major surface of the cured, lofty nonwoven web may be done using a spray gun system such as those available from Binks (Illinois, USA) in an amount that may be varied depending on the durability that needs to be shown by matting article 100. The amount of the additional binder solution may have a weight within the tolerance limits of 36-240 grams per square meter as dried total solids. This step is called "spray coating".

In some embodiments, the "spray coating" procedure may be carried out in a spray booth with a recuperation mechanism to recycle binder solution applied.

The binder resin mixture may be prepared in a tank made of stainless steel and having a mixing system such as propel or a pneumatic device. Examples of the mixing system can be found with SPX Company (North Carolina, USA) and Pulsair Systems Incorporated (Washington, USA.). The viscosity and solids are measured in the mixture to verify properties for "roll coating" and "spray coating."

The web having the roll coated zone 110 is then coated on the untreated face with a solution of a pressure-sensitive adhesive to form the adhesive coated layer 120 as shown in FIG. 2. In some embodiments, the amount of pressure-sensitive adhesive in the solution can be in the range of 20 to 50% in weight, being water the rest of weight in the solution. In some embodiments, the solids content in the pressure-sensitive adhesive can be selected from the range of 20 to 75%, and viscosity from the range of 60 to 8,000 centipoises.

Other range for solids content and viscosity are possible depending on the spray system selected for the application of the pressure-sensitive adhesive solution. The pressure-sensitive adhesive solution may have a viscosity of 60 to 2500 centipoise in order to ensure a formation of small drops by the spraying system which will later deposited on the web. The amount of the solution having the pressure-sensitive adhesive may be sprayed in such a way as per obtaining a weight in the range of 8 to 60 grams per square meter of dried solids. The pressure-sensitive adhesive solution may dry with an oven adjusted in a temperature range of 100 to 160° C. for 1 to 5 minutes. The solution of the pressure-sensitive adhesive may be sprayed in a spray booth with a recuperation mechanism to recycle solution applied.

In some embodiments of the process, when application of a second binder resin is being included, the application of pressure-sensitive adhesive may either precede or follow the application of the second binder resin.

Samples of matting article 100 were prepared and tested to examine properties and features relevant to matting performance, as described in the EXAMPLES section.

List of Embodiments

Embodiments of the current description may include, for example, any of the following "Items":

Item 1 is a matting article 100 for removing and holding dust, mud, dirt, and water, the matting article comprising:

(a) a lofty nonwoven web of 110 entangled fibers comprising organic crimped staple fibers which are adhesively bonded together by a binder resin to form a three dimensional network of intercommunicated voids constituting at least 75% of the volume of the lofty nonwoven web; and (b) a coating of pressure-sensitive adhesive 120 on a first major surface 115 of the lofty nonwoven web; wherein the matting article has a maximum density of 95 kilograms per cubic meter.

Item 2 is the matting article of item 1, wherein the organic crimped staple fibers comprise polymer selected from the group consisting of polypropylene, polyethylene, polyamide, polyethylene terephthalate, polyester, and combinations thereof.

Item 3 is the matting article of item 2, wherein the organic crimped staple fibers have a denier value of between 15 denier and 80 denier.

Item 4 is the matting article of any one of the preceding items, wherein the three dimensional network of intercommunicated voids constitute at least 90% of the volume of the lofty nonwoven web.

Item 5 is the matting article of any one of the preceding items, wherein the matting article has a maximum density of 20 kilograms per cubic meter.

Item 6 is the matting article of any one of the preceding items, wherein the organic crimped staple fibers have a length of from 3 centimeters to 10 centimeters.

Item 7 is the matting article of any one of the preceding items, wherein the organic crimped staple fibers have a length of from 4 centimeters to 7 centimeters.

Item 8 is the matting article of any one of the preceding items, wherein the binder resin is selected from the group consisting of acrylic resin, phenolic resin, nitrile resin, ethylene vinyl acetate resin, polyurethane resin, styrene-butadiene resin, styrene-acrylic resins, vinyl acrylic resin and combinations thereof.

Item 9 is the matting article of any one of the preceding items, wherein the binder resin is heat cured.

Item 10 is the matting article of item 9, wherein the amount of heat cured binder resin as dried solids is in a range of from 20 grams per square meter to 400 grams per square meter.

Item 11 is the matting article of item 9, wherein the amount of heat cured binder resin as dried solids is in a range of from 98 grams per square meter to 110 grams per square meter.

Item 12 is the matting article of any one of the preceding items, further comprising a coating comprising heat cured binder resin on a second major surface 125 of the lofty nonwoven web 110.

Item 13 is the matting article of item 12, wherein the amount of heat cured binder resin as dried solids on a second major surface 125 of the lofty nonwoven web 110 is in a range of from 36 grams per square meter to 240 grams per square meter.

Item 14 is the matting article of any one of the preceding items, wherein the pressure-sensitive adhesive (PSA) is a water-based PSA or a solvent-based PSA.

Item 15 is the matting article of item 1, wherein the pressure-sensitive adhesive is selected from the group consisting of acrylic adhesive, ethylene-vinyl acetate adhesive, synthetic rubber adhesive, natural rubber adhesive, tackifier resin adhesive, and combinations thereof.

Item 16 is the matting article of item 15, wherein an average amount of the pressure sensitive adhesive coating as dried solids is in a range of from 8 grams per square meter to 60 grams per square meter.

Item 17 is the matting article of item 16, wherein an average amount of the pressure sensitive adhesive coating as dried solids is 8 grams per square meter.

Item 18 is the matting article of any one of the preceding items, having a thickness in a range from 0.5 centimeters to 2.0 centimeters.

Item 19 is the matting article of any one of the preceding items, having a thickness in a range of from 1 centimeters to 1.5 centimeters.

Item 20 is the matting article of item 19, having a weight loss value in a range of from 7 percent to 12 percent when tested according to the Durability Test.

Item 21 is a process for making the matting article of item 1, the process comprising:

forming a nonwoven web of crimped staple organic fibers;

coating the nonwoven web with a binder resin;

heat curing the coated nonwoven web; and applying a pressure-sensitive adhesive to a first major surface of the coated nonwoven web.

Item 22 is the process of item 21, further comprising drying the pressure sensitive adhesive to obtain a dried coating of pressure sensitive adhesive having a weight in a range of from 8 grams per square meter to 60 grams per square meter.

Item 23 is the process of any one of item 21 or item 22, further comprising applying an additional binder resin on a second major surface thereof, after heat curing the coated nonwoven web.

EXAMPLES

Test Methods

Dust and Dirt Retention Test

The finished floor mat material was tested to check its dust and dirt retention by cutting a 9.2 centimeter width by 15 centimeters length (138 square centimeter) sample that was placed on a flat table, the side that had the pressure-sensitive adhesive sprayed being placed against the table surface. Three hundred grams of fine dust and dirt (mesh 200-220) having 2% by weight water content was sprinkled onto the floor mat sample at distance of 15 centimeters from the surface of the table. The floor mat sample was lifted from the table and shaken manually up and down five times to eliminate excess of dust and dirt applied. The difference in weight of the dirt and dust before and after the sample was shaken, was used to calculate the percent of this materials retained.

Water Retention Test

The finished floor mat was tested to check its water retention by placing 9.2 centimeter width by 15 centimeters length (138 square centimeter) sample inside a four liter glass vessel having two liters of distilled water at room temperature. The sample remained submerged for 30 seconds and after this time it was removed and allowed to drain in for 5 seconds in order to eliminate excess water. The difference in weight in the sample was taken as the amount of water retained.

Durability Test

The durability of the floor mat was measured as the ability of the mat to withstand wear by weighing a 4 centimeters width by 10 centimeters length matting sample and then abrading the major surface that did not have the pressure-sensitive adhesive coating by moving the matting sample backwards and forwards relative to abrasive surface of a piece of a P220 abrasive sandpaper manufactured and distributed by 3M Company (Beauchamp, France) that was approximately 5 centimeters wide by 40 centimeters long. An approximately 2.40 kilogram weight was used to keep the matting sample in contact with the face of the abrasive sandpaper. The matting sample was weighed after a specified number of passes and the difference in weight was recorded to calculate the percent of sample lost.

Washing Machine Test

The finished floor mat was also evaluated in a washing machine test using a conventional home washing machine obtained from COMAEM S.A. (Madrid, Spain) water at 75° C., dish washing detergent (Procter & Gamble Company liquid detergent commercialized with the brand of "Salvo") and a period of 30 minutes of normal agitation.

Scratch Test (Schieffer Test)

A Schieffer testing was used to simulate the abrasive qualities of the floor mat. A circular sample of the floor mat having a diameter of 10 centimeters was obtained by using a manual die cut press. The testing surface to be abraded by the floor mat sample was a disc made of an acrylic polymer, 0.5 inches thick, 90-105 shore hardness, and 10 centimeters in diameter. The acrylic disc was weighed to the nearest milligram before starting the test to obtain an initial weight value (W1). The testing machine was a Schieffer Abrasion Machine (available from Frazier Precision Company, Gaithersburg, USA) fitted with a spring clip retaining plate to secure the testing surface on the bottom turntable and a mechanical fastener (Scotch-Mate Dual Lock SJ3442 Type 170) to hold the floor mat on the upper turntable. For each test, a counter was set to 500 revolutions. The acrylic disc was mounted via the spring-clip to the lower turntable. The floor mat sample was placed in such a way that the side not coated with the pressure-sensitive adhesive was facing downward, towards the acrylic disc. A 4.55 kilogram load weight was placed on the load platform of the abrasion tester. The upper turntable was lowered to contact the acrylic disc under the full force of the load weight, and the machine was started. After 500 revolutions the machine was turned off, the floor mat sample removed from the upper turntable and discarded, and the acrylic disc was removed from the lower turntable. Any free dust was removed from the acrylic disc by wiping with a dry paper towel, and the acrylic disc was weighed again to obtain a final weight value (W2.) The percent of weight loss in the acrylic disc was calculated using the following equation:

$$\% \text{ weight loss} = (W2 - W1)/W1$$

Example 1

Floor Matting Material from 200 Denier Polyamide Fibers and Styrene-Butadiene Binder A binder solution was prepared in a stainless steel tank equipped with a mixer (obtained from SPX Company, Charlotte, N.C., USA, under the trade name "LIGHTNIN MIXER") to mix thoroughly the components listed in Table 1. The binder solution so obtained had a viscosity of 100 cps (Brookfield viscometer, 12 rpm, #3 spindle, room temperature).

TABLE 1

Binder solution for Example 1.

| Component | Weight % |
|---|---|
| Styrene-butadiene emulsion at 50% solids (Mallard Creek Polymers, North Carolina, USA) | 59 |
| Water | 40 |
| Blue pigment dispersion (Sun Chemical, Pennsylvania, USA) | 1 |

A lofty nonwoven web was made from 200 denier polyamide 6,6 fiber crimped staple fibers, 5 centimeters in length (Rhodia S.A., Paris, France) using a Rando Webber machine configured with an opener box, a carding SCS machine, and a cross-lapper. The fibers were initially fed into a conventional Garnett machine to loosen and to separate the fibers from the strands as received from the manufacturer, this preliminary step being highly desirable but not essential. The loosened staple fibers from the Garnett machine were then transferred to the feed box of the Rando-Webber machine, the feed box being kept approximately one-fourth to three-fourths filled in the interest of uniformity of the web. The Rando Webber machine was adjusted to form a lofty nonwoven web having a weight of 663.5 grams per square meter, a width of 1.016 meters and a thickness of 7.4 centimeters.

When the Rando-Webber machine was producing a lofty nonwoven web within the desired tolerances, the web from the machine was led onto a continuous conveyor belt system where it passed between a pair of vertically opposed, rotating, 250 mm diameter rubber covered, steel squeeze rollers separated by a gap of about 2.2 millimeters. The rotating lower roll, which was immersed in the binder solution, carried the binder solution to the web so as to coat it completely. The wet web was dried and the binder solution cured in a hot air oven at about 130° C. for about 3 minutes. The amount of binder solution coated as dried solids was of 672.33 grams per square meter. The resultant lofty nonwoven web having the cured binder resin was sprayed on one side using a spray gun system available from Binks (Glendale Heights, Ill., USA) with a solution consisting of 30% in weight of the pressure-sensitive ethylene-vinyl acetate adhesive Flexbond 165 (50%, AP Resinas (Mexico City, Mexico) and 70% in weight of water, the solution of adhesive and water having a viscosity of 272 centipoise, and the web coated with pressure-sensitive adhesive was then passed through an oven at 130° C. for 2 minutes, so that the amount of dried pressure-sensitive adhesive deposited was 18 grams per square meter on average.

The finished floor mat had a thickness of 1.74 centimeters, a density of 90.5 kilograms per cubic meter and showed staple fibers firmly bonded together at points where they cross and contact one another helped by the binder solution already cured, and in such a way that the final structure had a three-dimensional form. Test results for the matting article of Example 1 are shown in Table 8.

Example 2

Floor Matting Material from 70 Denier Polyamide Fibers and Acrylic Binder

A binder solution was prepared in a stainless steel tank equipped with a mixer (obtained from SPX Company, Charlotte, N.C., USA, under the trade name "LIGHTNIN MIXER") to mix thoroughly the components listed in Table 2. The binder solution so obtained had a viscosity of 100 cps (Brookfield viscometer, 12 rpm, #3 spindle, room temperature).

TABLE 2

Binder solution for Example 2.

| Component | % in weight |
|---|---|
| Acrylic emulsion 50% solids (Dow Company, New Jersey, US) | 59 |
| Water | 40 |
| Green pigment dispersion (Sun Chemical, Pennsylvania, US) | 1 |

A lofty nonwoven web was made from 70 denier polyamide 6,6 fiber crimped staple fibers, 5 centimeters in length (Meryl Fiber S.A.S, Saint-Laurent-Blangy, France), following essentially the procedure described in Example 1. The Rando Webber machine was adjusted to form a lofty nonwoven web having a weight of 471 grams per square meter, a width of 1.016 meters and a thickness of 4.83 centimeters.

When the Rando Webber machine was producing a lofty nonwoven web within the desired tolerances, the web from the machine was led onto a continuous conveyor belt system where it passed between a pair of vertically opposed, rotating, 250 mm diameter rubber covered, steel squeeze rollers, separated by a gap of about 1.9 millimeters. The rotating lower roll, which was immersed in the binder solution, carried the binder solution to the web so as to coat it completely. The wet web was dried and the binder solution cured in a hot air oven at about 130° C. for about 2 minutes. The amount of binder solution coated as dried solids was of 470.14 grams per square meter. The resultant lofty nonwoven web having the cured binder resin was sprayed on one side using a spray gun system available from Binks (Glendale Heights, Ill., USA) with a solution consisting of 30% in weight of the pressure-sensitive ethylene-vinyl acetate adhesive Flexbond 165 (50% solidos, AP Resinas (Mexico City, Mexico) and 70% in weight of water, the solution of adhesive and water having a viscosity of 285 centipoise, and the web coated with pressure-sensitive adhesive was then passed through an oven at 130° C. for 2 minutes so that the amount of dried pressure-sensitive adhesive deposited was 18 grams per square meter on average.

The finished floor mat had thickness of 1.75 centimeters, a density of 52.7 kilograms per cubic meter and showed staple fibers firmly bonded together at points where they cross and contact one another helped by the binder solution already cured, and in such a way that the final structure had a three-dimensional form. Test results for the matting article of Example 2 are shown in Table 8.

Example 3

Floor Matting Material from 15 Denier Polyester Fibers and Styrene-Butadiene Binder A first binder solution was prepared in a stainless steel tank equipped with a mixer (obtained from SPX Company, Charlotte, N.C., USA, under the trade name "LIGHTNIN MIXER") to mix thoroughly the components listed in Table 3. The binder solution so obtained had a viscosity of 140 cps (Brookfield viscometer, 12 rpm, #3 spindle, room temperature).

TABLE 3

First binder solution for Example 3.

| Component | % in weight |
|---|---|
| Styrene-butadiene emulsion at 50% solids (Myllard Creek Polymers, North Carolina USA) | 59 |
| Cymel 303 (Cytec Industries, New Jersey, USA) | 5.9 |
| Water | 34.1 |
| Black pigment dispersion (Sun Chemical, Pennsylvania, US) | 1 |

A lofty nonwoven web was made from 15 denier DACRON polyester crimped staple fibers, 5 centimeters in length distributed by DAK Fibers (Mexico City, Mexico), and following essentially the procedure described in Example 1. The Rando Webber machine was adjusted to form a lofty nonwoven web having a weight of 226 grams per square meter, a width of 1.066 meters, and a thickness of 3.97 centimeters.

When the Rando Webber machine was producing a lofty nonwoven web within the desired tolerances, the web from the machine was led onto a continuous conveyor belt system where it passed between a pair of vertically opposed, rotating, 250 mm diameter rubber covered, steel squeeze rollers, separated by a gap of about 1.9 millimeters. The rotating lower roll, which was immersed in the binder solution, carried the binder solution to the web so as to coat it completely. The wet web was dried and the binder solution cured in a hot air oven at about 130° C. for about 50 seconds. The amount of binder solution coated as dried solids was of 217 grams per square meter. The resultant lofty nonwoven web having the cured binder resin was sprayed on one side using a spray gun system available from Binks (Glendale Heights, Ill., USA) with a solution consisting of 30% in weight of the pressure-sensitive ethylene-vinyl acetate adhesive Flexbond 165 (50% solids, AP Resinas (Mexico City, Mexico)), and 70% in weight of water, the solution of adhesive and water having a viscosity of 280 centipoise. The web coated with pressure-sensitive adhesive was then passed through an oven at 130° C. for 2 minutes, so that the amount of dried pressure-sensitive adhesive deposited was 25 grams per square meter on average.

The second major surface of the lofty nonwoven web (opposite the major surface of the nonwoven web that was coated with pressure-sensitive adhesive) was then sprayed with a second binder solution consisting of the components listed in Table 4,

TABLE 4

Second binder solution for Example 3.

| Component | % in weight |
|---|---|
| Styrene-butadiene emulsion at 50% solids | 50 |
| Water | 39 |
| Calcium carbonate | 10 |
| Pigment dispersión | 1 |

The second binder solution was prepared in stainless steel tank equipped with a mixer (obtained from SPX Company, Charlotte, N.C., USA, under the trade name "LIGHTNIN MIXER") to mix thoroughly the components during 15 minutes. The second binder solution had a viscosity of 195 centipoise and was sprayed in an amount of 3.9 grams (wet weight) per 138 square centimeters using a spray gun system available from Binks (Glendale Heights, Ill., USA), and later dried by passing the floor mat through an oven at 120° C. for 50 seconds using an oven.

Figure 6:
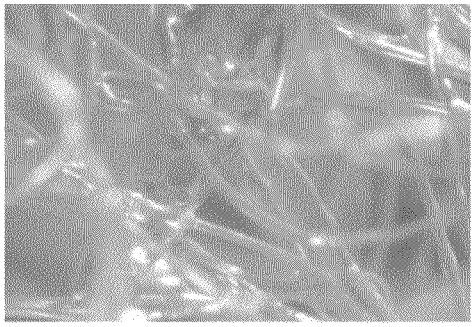

The finished floor mat material had thickness of 1.58 centimeters, a density of 31.6 kilograms per cubic meter and showed staple fibers firmly bonded together at points where they cross and contact one another helped by the binder solution already cured, and in such a way that the final structure had a three-dimensional form. A 40× microscopic view of the matting article of Example 3 is shown in FIG. 6. Test results for the matting article of Example 3 are shown in Table 8.

Example 4

Floor Matting Material from 15 Denier Polyester Fibers and Styrene-Butadiene Binder, and Solvent Based Pressure Sensitive Adhesive A first binder solution was prepared in a stainless steel tank equipped with a mixer (obtained from SPX Company, Charlotte, N.C., USA, under the trade name "LIGHTNIN MIXER") to mix thoroughly the components listed in Table 5. The binder solution so obtained had a viscosity of 140 cps (Brookfield viscometer, 12 rpm, #3 spindle, room temperature).

TABLE 5

First binder solution for Example 4.

| Component | % in weight |
|---|---|
| Styrene-butadiene emulsion at 50% solids (Mallard Creek Polymers, Charlotte, NC, US) | 59 |
| Cymel 303 (Cytec Industries, Woodland Park, NJ, USA) | 5.9 |
| Water | 34.1 |
| Black pigment dispersion (Sun Chemical, Allentown, PA, US) | 1 |

A lofty nonwoven web was made from 15 denier DACRON polyester crimped staple fibers, 5 centimeters in length distributed by DAK Fibers, (Mexico City, Mexico), following essentially the procedure described in Example 1. The Rando Webber machine was adjusted to form a random non-woven web having a weight of 217 grams per square meter, a width of 1.066 meters, and a thickness of 3.4 centimeters.

When the Rando Webber machine was producing a lofty nonwoven web within the desired tolerances, the web from the machine was led onto a continuous conveyor belt system where it passed between a pair of vertically opposed, rotating, 250 mm diameter rubber covered, steel squeeze rollers, separated by a gap of about 1.9 millimeters. The rotating lower roll, which was immersed in the binder solution, carried the binder solution to the web so as to coat it completely. The wet web was dried and the binder solution cured in a hot air oven at about 130° C. for about 50 seconds. The amount of binder solution coated as dried solids was of 219.2 grams per square meter. The resultant lofty nonwoven web having the cured binder resin was sprayed on second major surface 125 using a spray gun system available from Binks (Glendale Heights, Ill., USA) with a solution of an additional binder resin consisting of the components listed in Table 6:

TABLE 6

Second binder solution for Example 4.

| Component | % in weight |
|---|---|
| Styrene-butadiene emulsion at 50% solids (Mallard Creek Polymers, North Carolina, US) | 50 |
| Water | 39 |
| Calcium carbonate (Omya, Safenwil, Switzerland) | 10 |
| Black pigment dispersion (Sun Chemical, Pennsylvania, US) | 1 |

The second binder solution was prepared in stainless steel tank which had a LIGHTNIN mixer (SPX Company, Charlotte, N.C., US) to mix thoroughly the components during 15 minutes. The second binder solution had a viscosity of 195 centipoise and was sprayed onto second major surface 125 in an amount of 3.87 grams (wet weight) per 138 square centimeters using a spray gun system available from Binks (Glendale Heights, Ill., USA), and later dried by passing the floor mat through an oven at 120° C. for 50 seconds using an oven.

The first major surface 115 of the lofty nonwoven web (opposite to the second major surface 125 of the nonwoven web that was coated with the solution of additional binder resin) was then coated with a solution of the pressure-sensitive adhesive composition shown in table 7:

TABLE 7

Solvent based pressure-sensitive adhesive solution for Example 4.

| Component | % in weight |
|---|---|
| Styrene-isoprene-styrene rubber (Kraton Polymers, Texas, US) | 22 |
| Wintak Plus tackifying resin (Goodyear Intl., Texas, US) | 23 |
| Toluene | 55 |

The pressure-sensitive adhesive solution shown in table 7 was prepared adding components in a stainless steel tank and mixing with a LIGHTNIN mixer (SPX Company, Charlotte, N.C., USA) until complete dissolution. The finished solution had 45% total solids and a viscosity of 1600 centipoise. The web coated with pressure-sensitive adhesive was then passed through an oven at 130° C. for 2 minutes, so that the amount of dried pressure-sensitive adhesive deposited was 25 grams per square meter on average.

The finished floor mat material had thickness of 1.7 centimeters, a density of 29.2 kilograms per cubic meter and showed staple fibers firmly bonded together at points where they cross and contact one another helped by the binder solution already cured, and in such a way that the final structure had a three-dimensional form.

A 40× microscopic view of the matting article of Example 4 is shown in FIG. 7. Test results for the matting article of Example 4 are shown in Table 8.

TABLE 8

Test Results for Examples 1-4

| Descriptor/Test Method | Example 1 | Example 2 | Example 3 | Example 4 |
|---|---|---|---|---|
| Thickness of Finished Mat (cm) | 1.74 | 1.75 | 1.58 | 1.7 |
| Dust and Dirt Retention Test (% wt retention) | 82.8% | 73.5% | 90.1% | 89.8% |
| Water Retention Test ($g/cm^2$) | 0.175 | 0.22 | 0.3 | 0.295 |
| Durability Test (% wt loss) | 8.2% | 9.6% | 10.26% | 10.03% |
| Washing Machine Test (% wt loss) | 2.2% | 1.8% | 2.1% | 1.9% |
| Scratch Test (% wt loss) | <0.1% | <0.1% | <0.1% | <0.1% |

What is claimed is:

1. A matting article for removing and holding dust, mud, dirt, and water, the matting article comprising:

(a) a lofty nonwoven web of entangled fibers comprising organic crimped staple fibers which are adhesively bonded together by a binder resin to form a three dimensional network of intercommunicated voids constituting at least 75% of the volume of the lofty nonwoven web; and (b) a coating of pressure-sensitive adhesive on a first major surface of the lofty nonwoven web wherein the pressure sensitive adhesive is configured to maintain the matting article in place on a floor surface;

wherein the matting article has a maximum density of 95 kilograms per cubic meter.

2. The matting article of claim 1, wherein the organic crimped staple fibers comprise polymer selected from the group consisting of polypropylene, polyethylene, polyamide, polyethylene terephthalate, polyester, and combinations thereof.

3. The matting article of claim 2, wherein the organic crimped staple fibers have a denier value of between 15 denier and 80 denier.

4. The matting article of claim 1, wherein the three dimensional network of intercommunicated voids constitute at least 90% of the volume of the lofty nonwoven web.

5. The matting article of claim 1, wherein the matting article has a maximum density of 20 kilograms per cubic meter.

6. The matting article of claim 1, wherein the organic crimped staple fibers have a length of from 3 centimeters to 10 centimeters.

7. The matting article of claim 1, wherein the organic crimped staple fibers have a length of from 4 centimeters to 7 centimeters.

8. The matting article of claim 1, wherein the binder resin is selected from the group consisting of acrylic resin, phenolic resin, nitrile resin, ethylene vinyl acetate resin, polyurethane resin, styrene-butadiene resin, styrene-acrylic resins, vinyl acrylic resin and combinations thereof.

9. The matting article of claim 1, wherein the binder resin is heat cured.

10. The matting article of claim 9, wherein the amount of heat cured binder resin is in a range of from 20 grams per square meter to 400 grams per square meter.

11. The matting article of claim 9, wherein the amount of heat cured binder resin is in a range of from 98 grams per square meter to 110 grams per square meter.

12. The matting article of claim 1, further comprising a coating comprising heat cured binder resin on a second major surface of the lofty nonwoven web.

13. The matting article of claim 12, wherein the amount of heat cured binder resin on a second major surface of the lofty nonwoven web is in a range of from 36 grams per square meter to 240 grams per square meter.

14. The matting article of claim 1, wherein the pressure-sensitive adhesive (PSA) is a water-based PSA or a solvent-based PSA.

15. The matting article of claim 1, wherein the pressure-sensitive adhesive is selected from the group consisting of acrylic adhesive, ethylene-vinyl acetate adhesive, synthetic rubber adhesive, natural rubber adhesive, tackifier resin adhesive, and combinations thereof.

16. The matting article of claim 15, wherein an average amount of the pressure sensitive adhesive coating is in a range of from 8 grams per square meter to 60 grams per square meter.

17. The matting article of claim 16, wherein an average amount of the pressure sensitive adhesive coating is in a range of from 8 grams per square meter to 18 grams per square meter.

18. The matting article of claim 1, having a thickness in a range from 0.5 centimeters to 2.0 centimeters.

19. The matting article of claim 1, having a thickness in a range of from 1 centimeter to 1.5 centimeters.

20. The matting article of claim 19, having a weight loss value in a range of from 7 percent to 12 percent when tested according to the Durability Test.

* * * * *